US008210359B2

(12) United States Patent
Lambert

(10) Patent No.: US 8,210,359 B2
(45) Date of Patent: Jul. 3, 2012

(54) FLOTATION CELL

(75) Inventor: Noel William Alexander Lambert, Lower Belford (AU)

(73) Assignee: Newcastle Innovation Limited, New South Wales (AU)

( * ) Notice: Subject to any disclaimer, the term of this patent is extended or adjusted under 35 U.S.C. 154(b) by 611 days.

(21) Appl. No.: 12/373,018

(22) PCT Filed: Jul. 12, 2007

(86) PCT No.: PCT/AU2007/000970

§ 371 (c)(1),
(2), (4) Date: Jan. 8, 2009

(87) PCT Pub. No.: WO2008/006165

PCT Pub. Date: Jan. 17, 2008

(65) Prior Publication Data

US 2009/0288995 A1 Nov. 26, 2009

(30) Foreign Application Priority Data

Jul. 12, 2006 (AU) ..... 2006903752

(51) Int. Cl.
*B03D 1/14* (2006.01)
*B03D 1/24* (2006.01)

(52) U.S. Cl. ..... 209/168; 209/170

(58) Field of Classification Search ..... 209/168, 209/170; 210/221.2

See application file for complete search history.

(56) References Cited

U.S. PATENT DOCUMENTS 4,470,903 A 9/1984 Van Leeuwen
4,664,802 A * 5/1987 Lee ..... 210/522
6,663,782 B2 * 12/2003 Morse et al. ..... 210/703
2004/0099575 A1 * 5/2004 Khan et al. ..... 209/164
2009/0288995 A1 * 11/2009 Lambert ..... 209/169

FOREIGN PATENT DOCUMENTS

DE 19915735 A1 10/2000
SE 8204346 A * 2/1984
SU 1789281 A2 1/1993
WO WO 2006/056018 A1 * 6/2006

OTHER PUBLICATIONS

International Search Report prepared by the Australian Patent Office on Sep. 25, 2007, for International Application No. PCT/AU2007/000970.

International Preliminary Report on Patentability prepared by the Australian Patent Office on Sep. 25, 2007, for International Application No. PCT/AU2007/000970.

* cited by examiner

*Primary Examiner* — Thomas M Lithgow
(74) *Attorney, Agent, or Firm* — Sheridan Ross P.C.

(57) ABSTRACT

A flotation cell for separating hydrophobic particles from hydrophilic particles uses a mixer (1) with an air inlet (8) and slurry feed (7) to form a bubbly mixture in a u-tube mixer (4, 5, 6) and feed the mixture into a separation vessel (2). Plant cost and operating efficiencies are optimised by gravity feed of slurry and admitting air at atmospheric pressure. The separation vessel (2) has an upper inclined plate (9) which guides the froth layer (33) containing the hydrophobic particles to an overflow launder (11) without any significant turbulence or change in direction optimising the retention of hydrophobic particles in the froth, while the hydrophilic particles drop down in the liquid layer (34) guided along a lower inclined plate (24) to a tailings outlet (14).

9 Claims, 11 Drawing Sheets

FLOTATION CELL

CROSS REFERENCE TO RELATED APPLICATIONS

This application is a national stage application under 35 U.S.C. 371 of PCT Application No. PCT/AU2007/000970 having an international filing date of 12 Jul. 2007, which designated the United States, which PCT application claimed the benefit of Australian Application No. 2006903752 filed 12 Jul. 2006, the entire disclosures of which are hereby incorporated herein by reference.

FIELD OF THE INVENTION

This invention relates to a flotation cell and has been devised particularly though not solely for the separation of minerals in a mining situation.

BACKGROUND OF THE INVENTION

Flotation is a now well recognised method of separating valuable particles ("values") from unwanted material ("gangue") in many different situations. One set of particles, typically the values, are conditioned by various reagents commonly referred to as conditioners, and may also be treated with frothers and collectors, so that they become hydrophobic and will adhere to bubbles in a froth where they can rise to the top of a separation vessel and be discharged typically into an overflow launder. The gangue is typically hydrophilic or treated to become hydrophilic and remains in the body of water within the separation vessel typically sinking to the bottom and being discharged as tails.

Many different types of flotation cells have been used in situations from mining, where they are commonly used to separate out the finer particles, to water purification and other parallel uses. One of the problems associated with existing flotation processes is the difficulty of keeping the values attached to the bubbles so that they will be carried to the top of the froth and overflow into the launder for recovery. Most flotation cells incorporate areas of high turbulence or require the bubbles with attached hydrophobic particles to change direction which results in the values becoming detached from the bubbles to simply become entrained in the bubbly mixture or to drop out with the gangue. This factor, significantly reduces the efficiency of known flotation cells.

SUMMARY OF THE INVENTION

A flotation vessel of the type wherein mixed particles are separated into hydrophobic particles generally discharged from the vessel in a froth layer in the form of bubbles with attached particles, and hydrophilic particles generally discharged as tails, the vessel including a mixer arranged to mix gas with a feed slurry carrying the mixed particles and form a bubbly mixture, and a separation vessel arranged to allow the bubbly mixture to separate into a froth bearing the hydrophobic particles for discharge from the upper part of the vessel, and a liquid containing the hydrophilic particles for discharge from the lower part of the vessel as tails, the mixer and the separation vessel being arranged such that the bubbly mixture enters the separation vessel in a generally upward direction and the separation vessel is provided with an upwardly inclined surface above the point of entry of the bubbly mixture such that the bubbly mixture follows this surface separating into a froth layer at the top of the separation vessel and liquid in the lower part of the separation vessel, with the result that the bubbles with attached hydrophobic particles continue to move upwardly into the froth layer in the vessel without a significant change in direction of movement.

Preferably the upwardly inclined surface has a lower edge located in close proximity to the entry point of the bubbly mixture into the separation vessel, and extends across the separation vessel to a higher edge located adjacent the exit point of froth from the separation vessel.

Preferably the exit point of the froth from the separation vessel is over a lip in the side wall of the vessel and into a launder.

Preferably the lower portion of the separation vessel is provided with a downwardly inclined surface having a lower edge terminating in a tails outlet.

In one form of the invention the downwardly inclined surface slopes downwardly away from the entry point of the bubbly mixture into the separation vessel.

Preferably in that same form of the invention the vessel has a side opposite the entry point of the bubbly mixture which has an upper part inclined inwardly into the vessel from an upper edge adjacent the discharge point to a nose portion substantially opposite said entry point, and a lower part inclined outwardly from the nose portion to a lower edge adjacent the tails outlet.

Preferably the nose portion is provided with a deflector plate spaced outwardly from the nose portion and arranged to divert liquid flowing down the upper part, around the nose portion so as to substantially follow the line of the lower part.

In one form of the invention the froth layer is discharged from the vessel through an upper inclined wash channel extending from the upper edge of, and generally inline with, the upwardly inclined surface, arranged such that wash water introduced into froth moving upwardly through the wash channel washes out hydrophilic particles remaining in the froth.

Preferably the washed out hydrophilic particles are guided downwardly from the wash channel into the lower part of the vessel.

A flotation vessel of the type wherein mixed particles are separated into hydrophobic particles generally discharged from the vessel in a froth layer in the form of bubbles with attached particles, and hydrophilic particles generally discharged as tails, the vessel including a mixer arranged to mix air with a feed slurry carrying the mixed particles and form a bubbly mixture, the mixer including a first substantially upright conduit where the feed slurry is mixed with the air introduced at substantially atmospheric pressure to form a bubbly mixture moving downwardly through the first conduit, and a second upright or inclined conduit having its lower end in communication with the lower end of the first conduit, wherein the bubbly mixture moves upwardly in the second conduit, the upper end of the second conduit being lower than the upper end of the first conduit, and a separation vessel arranged to receive the bubbly mixture discharged from the second conduit to separate into a froth bearing the hydrophobic particles for discharge from the upper part of the vessel and tails containing the hydrophobic particles for discharge from the lower part of the vessel.

Preferably the feed slurry is fed into the upper end of the first conduit through a nozzle as a downwardly plugging jet.

In one form of the invention the feed slurry is introduced at low pressure, typically by gravity feed.

In an alternative form of the invention the feed slurry is introduced under pressure from a pump.

Preferably the lower end of the first conduit communicates with the lower end of the second conduit by way of a curved extension of the conduits, forming a U-tube.

Preferably wherein the second conduit is of sufficient length that hydrophobic particles dislodged from bubbles during upward movement of the bubbly mixture in the second conduit have the opportunity to attach to further bubbles moving upwardly within the second conduit.

Preferably the combined length of the first and second conduits is sufficient to provide residence time allowing for improved hydrophobic particle connection with bubbles in the mixture.

In one form of the invention the second conduit increases in cross section from its lower end to the point of discharge into the separation vessel.

In one particular use of the invention a flotation vessel as described above may be ganged with other similar flotation vessels such that the tails from one flotation vessel become the feed slurry for the next flotation vessel.

BRIEF DESCRIPTION OF THE DRAWINGS

Notwithstanding any other forms that may fall within its scope, one preferred form of the invention will now be described by way of example only with reference to the accompanying drawings in which.

DETAILED DESCRIPTION

The preferred form of the invention will be described by way of reference to a flotation vessel, commonly referred to as a flotation cell set up for separating coal particles from gangue in a minerals separation adjunct to a mining operation, using air as the gas in the bubbly mixture, but it will be appreciated that a flotation cell of this configuration can be utilised for many other purposes including the separation of other minerals, water purification, and other uses such as frother stripping in separation plants, other uses could be in coal processing, waste-water processing, any aeration process or removal of dissolved materials.

A basic form of the invention will be described with reference to FIGS. 1 and 2 with further developments and variations on the invention described with reference to FIGS. 3 to 12.

Figure 1:
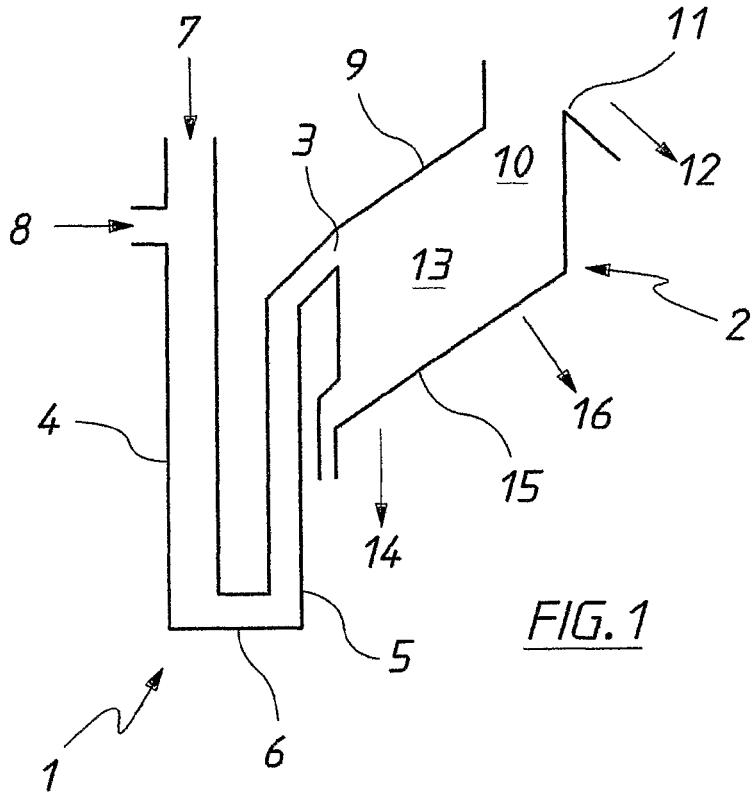
FIG. 1 is a diagrammatic cross-sectional elevation through a flotation cell according to the invention.

In the version shown in FIG. 1 the flotation cell includes a jet mixer 1 and a separation vessel 2 interconnected to feed bubbly mixture from the jet mixer 1 into the separation vessel 2 at point 3.

The jet mixer includes a first conduit 4 extending generally downwardly and a second conduit 5 extending generally upwardly connected at their lower ends 6 so as to form a u-tube in the configuration shown. Although the u-tube is shown as parallel sided and generally vertical in the accompanying drawings it will be appreciated that other variations are possible.

The feed slurry is fed into the upper end of the first conduit at 7 through a nozzle typically in a downwardly plunging jet and air at atmospheric pressure is entrained into the upper end of the first conduit at 8, mixing with the feed from the downwardly plunging jet and forming a turbulent bubbly mixture within the first conduit 4.

The first conduit 4 is sufficiently long to provide for thorough mixing and the opportunity for the hydrophobic particles to become attached to bubbles within the bubbly mixture which then passes through the lower end 6 of the u-tube and moves upwardly into the second conduit 5. The second conduit 5 is sufficiently long to enable the bubbly mixture to settle into a non-turbulent upward flow and also to allow hydrophobic particles dislodged from bubbles in the bubbly mixture to re-attach to lower bubbles rising within the second conduit 5.

The entire u-tube formed by parts 4, 5 and 6 is also sufficiently long to give sufficient residence time to allow for better particle collection and also for increased frother and excess collector collection.

In this manner, a bubbly mix is formed with a high percentage of the hydrophobic particles attached to bubbles moving in a uniform and quiet manner through the interconnection 3 and into the separation vessel 2.

The separation vessel 2 is typically configured with an upwardly inclined surface 9 located immediately above the discharge point 3 allowing the bubbly mixture to continue to rise upwardly in the separation vessel and gather in the froth area 10 toward the upper part of the vessel where it can be discharged over a launder lip 11 as froth 12 with attached values such as coal particles.

It is a particular feature of the flotation cell according to the invention that the bubbly mixture formed in the second conduit 5 continues to move generally upwardly through the interconnection 3 and through the separation vessel 2 without a significant change in direction of movement which is present in almost all other flotation cells and which causes hydrophobic particles to become detached from their bubbles and drop into the body 13 of the cell where they can become lost with the tailings.

As the bubbly mixture moves upwardly guided by the surface 9 toward the froth layer 10, the hydrophilic particles have time to drop out of the froth layer into the body 13 of the vessel where they progress downwardly and are discharged as tails at 14 or removed from other locations along the lower surface 15 of the vessel as further tails 16.

It has been found in trials that this configuration significantly increases the percentage of valuable particles or values that can be recovered in the froth 12.

Figure 2:
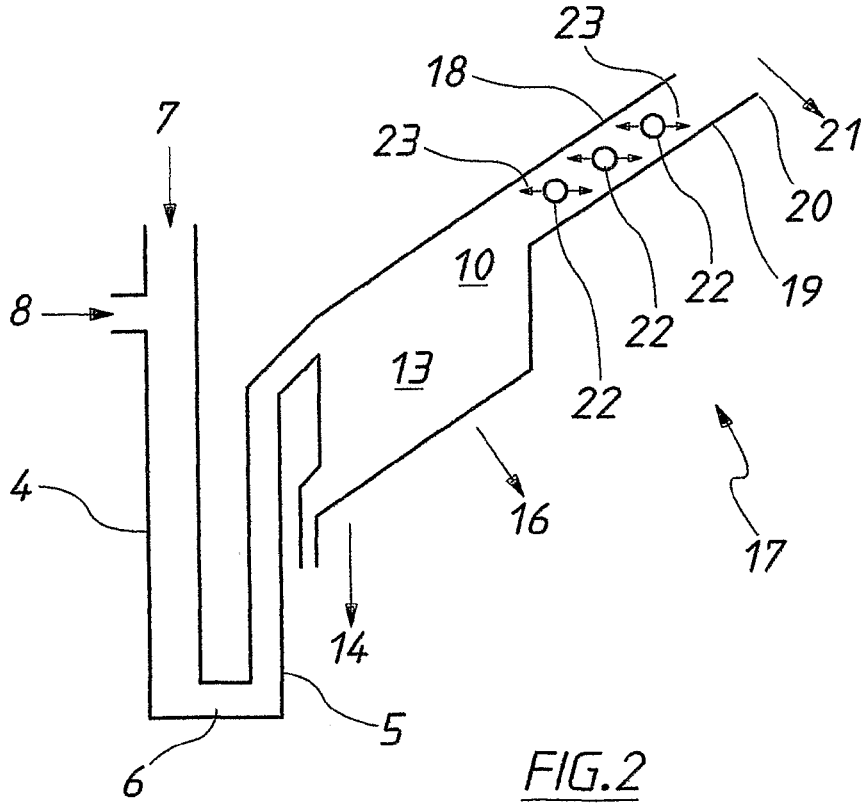
FIG. 2 is a similar view to FIG. 1 showing a variation with an attached froth washing device.

As an optional adjunct to the flotation cell described above, a further froth washing device 17 may be added as shown in FIG. 2. In this embodiment the froth layer at 10 is guided upwardly between an upper inclined plate 18 and a lower inclined plate 19 to an overflow lip 20 where the froth is discharged at 21.

Wash water may be introduced into the froth layer moving up between the inclined plates 18 and 19 by any suitable device but typically by way of wash water pipes 22 which pass horizontally between the inclined plates 18 and 19 (in this instance in and out of the page as represented diagrammatically in FIG. 2) and wash water is discharged from the pipes 22 in sprays diagrammatically represented by arrows 23.

This configuration enables material washed from the froth to fall onto the bottom inclined plate 19 and flow downwardly into the body 13 of the separation vessel 2. This material, typically hydrophilic and constituting unwanted gangue that was inadvertently entrained in the froth can then fall to the bottom of the separation vessel 13 and be discharged as tails at 14 or 16.

Although the froth washing device has been shown in one particular form diagrammatically, it will be appreciated that the froth may be allowed to drain from the lower inclined plate 19 between the wash water addition points and before and after the wash water addition points 22. The froth washing device may also be installed vertically and fingers for the collection of washed material may also be used as may a v-plate or other such suitable collection equipment. The wash water, although shown as issuing in substantially horizontal sprays 23 may be added at any angle from the wash water injection points.

The inclined plates can also be replicated to form an array of multiple plates in the froth washing device, and wash water can be introduced between plates and sprayed into neighbouring inter-plate areas through holes in the plates. Variations of froth washer devices are described further below.

The plates can also fan out (increase in width in plan view) toward the overflow lip 20 to reduce the froth velocity and increase residence time and exposure to the wash water.

It is also possible to move the froth along the froth washing device by mechanical assistance or by injecting air through the lower inclined plate 19 particularly if required to lift out thickened foam from between the plates 18 and 19.

In other embodiments, the second conduit is further configured to improve the separation of bubbles from the bubbly mixture, by either increasing its diameter or configuring its shape as an upwardly inclined tube. This is described further below.

Figure 3:
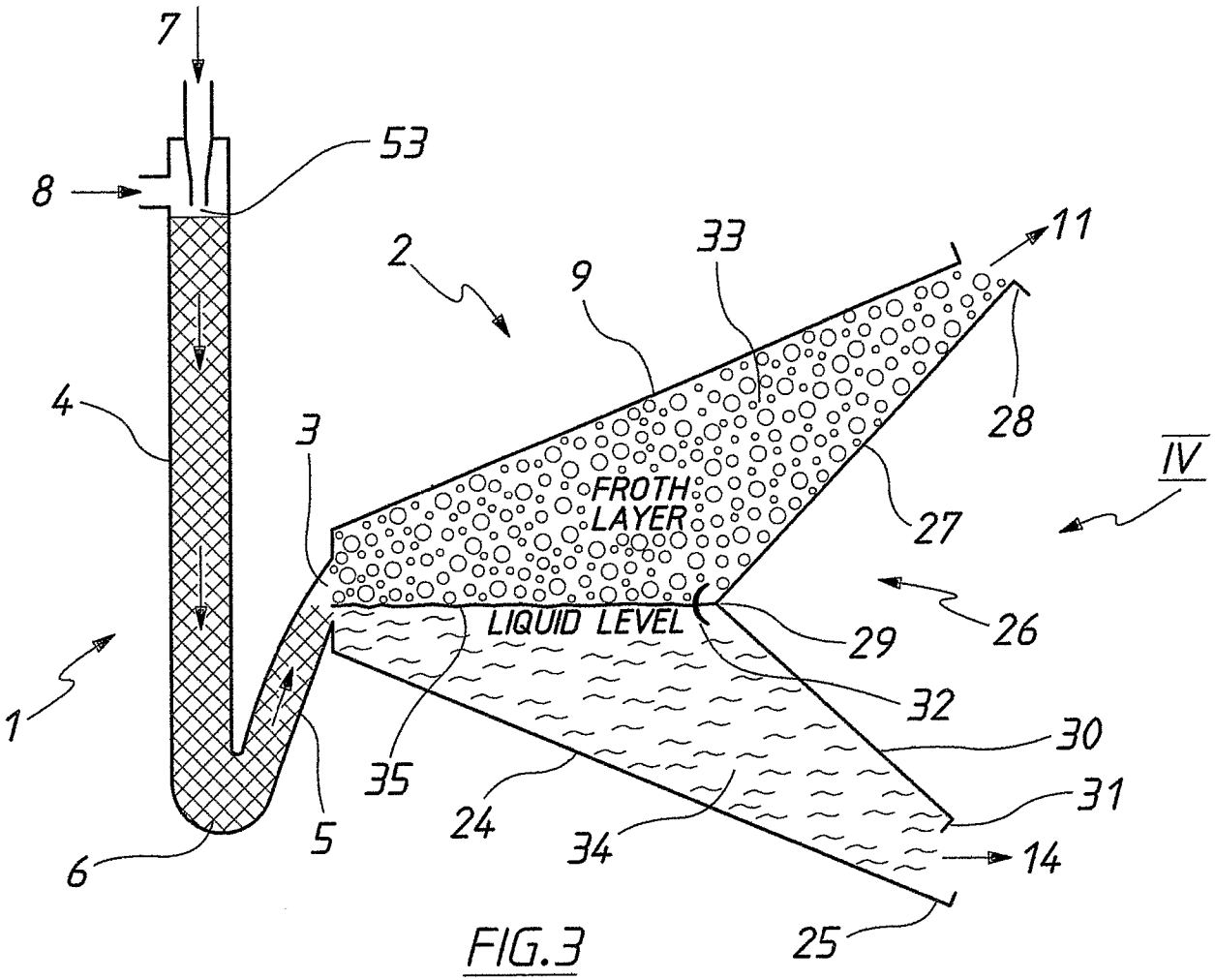
FIG. 3 is a diagrammatic cross-sectional elevation through an alternative form of flotation cell according to the invention.

Turning now to FIG. 3 there is shown an alternative form of the invention in which like numbered items previously described with reference to the embodiment in FIGS. 1 and 2 are shown by like numerals but which differs from the earlier described embodiment in the following ways.

The second conduit 5 of the mixer 1 is inclined rather than being substantially vertical and enters the separation vessel 2 at 3 with the bubbly mixture moving in a generally upwardly inclined direction.

The lower wall of the separation vessel 2 is formed as a downwardly inclined surface 24 sloping downwardly away from the entry point 3 of the bubbly mixture into the separation vessel to a lower edge 25 terminating in the tails outlet 14.

The version of the separation vessel shown in FIG. 3 has a side 26 opposite the entry point of the bubbly mixture 3 which has an upper part 27 inclined inwardly into the vessel from an upper edge 28 adjacent the discharge point 11 to a nose portion 29 substantially opposite the entry point 3. The side wall 26 further comprises a lower part 30 inclined outwardly from the nose portion 29 to a lower edge 31 adjacent the tails outlet 14.

The nose portion 29 is further provided with a deflector plate 32 spaced outwardly from the nose portion and arranged to divert liquid flowing down the upper part 27 around the nose portion 29 so as to substantially follow the line of the lower part 30. In this manner, any liquid falling out of the froth layer 33 onto the upper part 27 and typically containing hydrophilic particles is able to move down the surface of the upper part 27 within the cell, and be deflected around the corner of the nose portion 29 by the deflector plate 22 and into the liquid portion 34 without disturbing the liquid interface 35 between the forth layer 33 and the liquid 34 in the bottom part of the cell.

It has been found in practice that this configuration of the flotation vessel according to the invention is particularly effective in achieving the objective of moving the hydrophobic particles from the entry point 3 across the cell to the outlet at launder lip 11 without any significant change in direction while the hydrophilic particles are able to settle into the lower part of the cell in the liquid at 34 moving down the lower plate 24 to the tails outlet at 14. In this manner the movement of all particles and bubbles within the flotation cell is generally from left to right as seen in FIG. 3 with the hydrophobic particles moving upwardly attached to bubbles in the froth layer 33 and the hydrophilic particles moving downwardly into the liquid in the bottom portion of the cell at 34.

Figure 4:
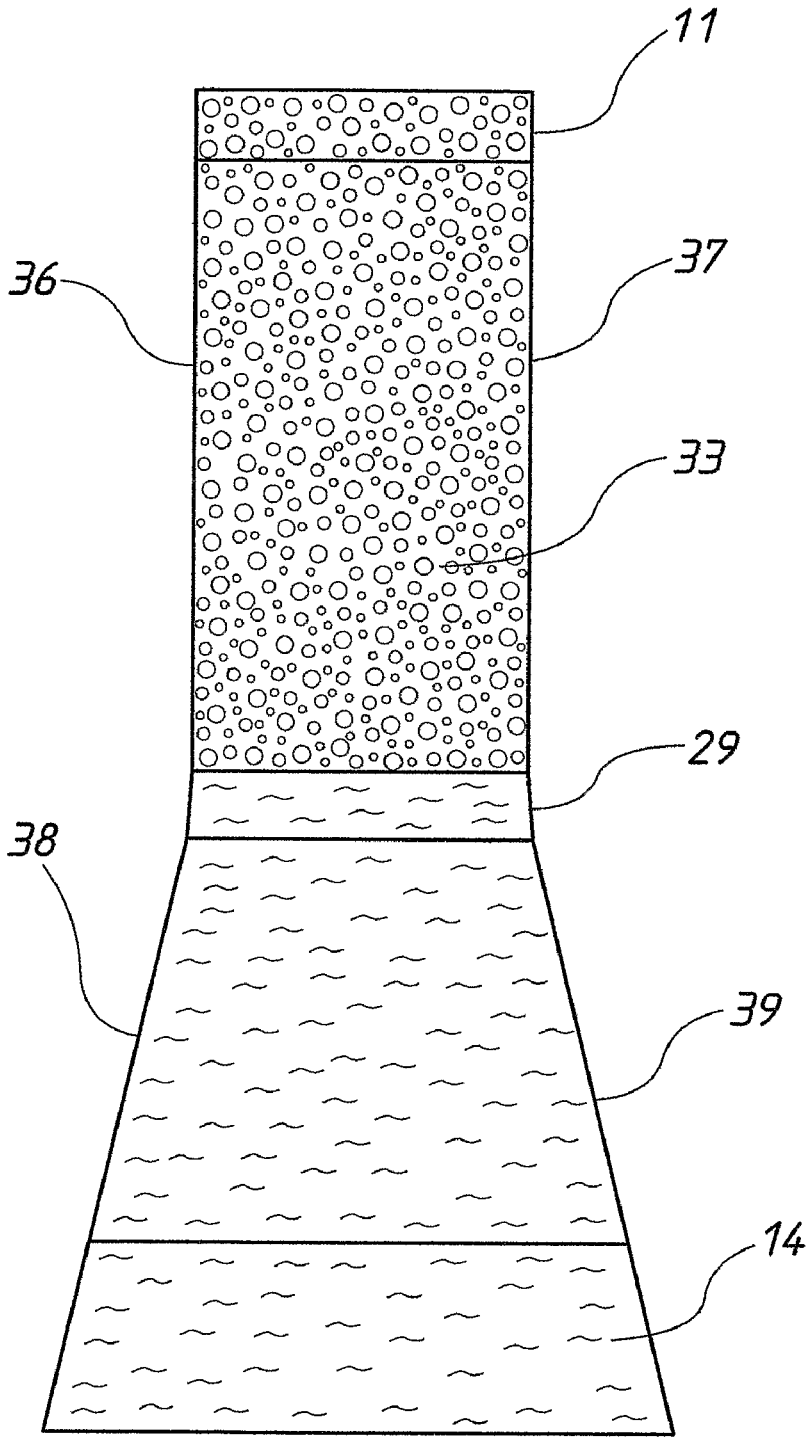
FIG. 4 is an end view on the arrow IV as shown in FIG. 3.

As can be seen from FIG. 4 it is also possible to configure the cell so that the upper portion is parallel sided being defined between side plates 36 and 37 which in conjunction with plates 9 and 27 contain the froth layer 33 while the lower portion of the cell below the deflector plate 29 can flare outwardly between side plates 38 and 39 to a wider tails outlet at 14. This has been found to increase the effectiveness of a cell of this configuration in operation.

Figure 5:
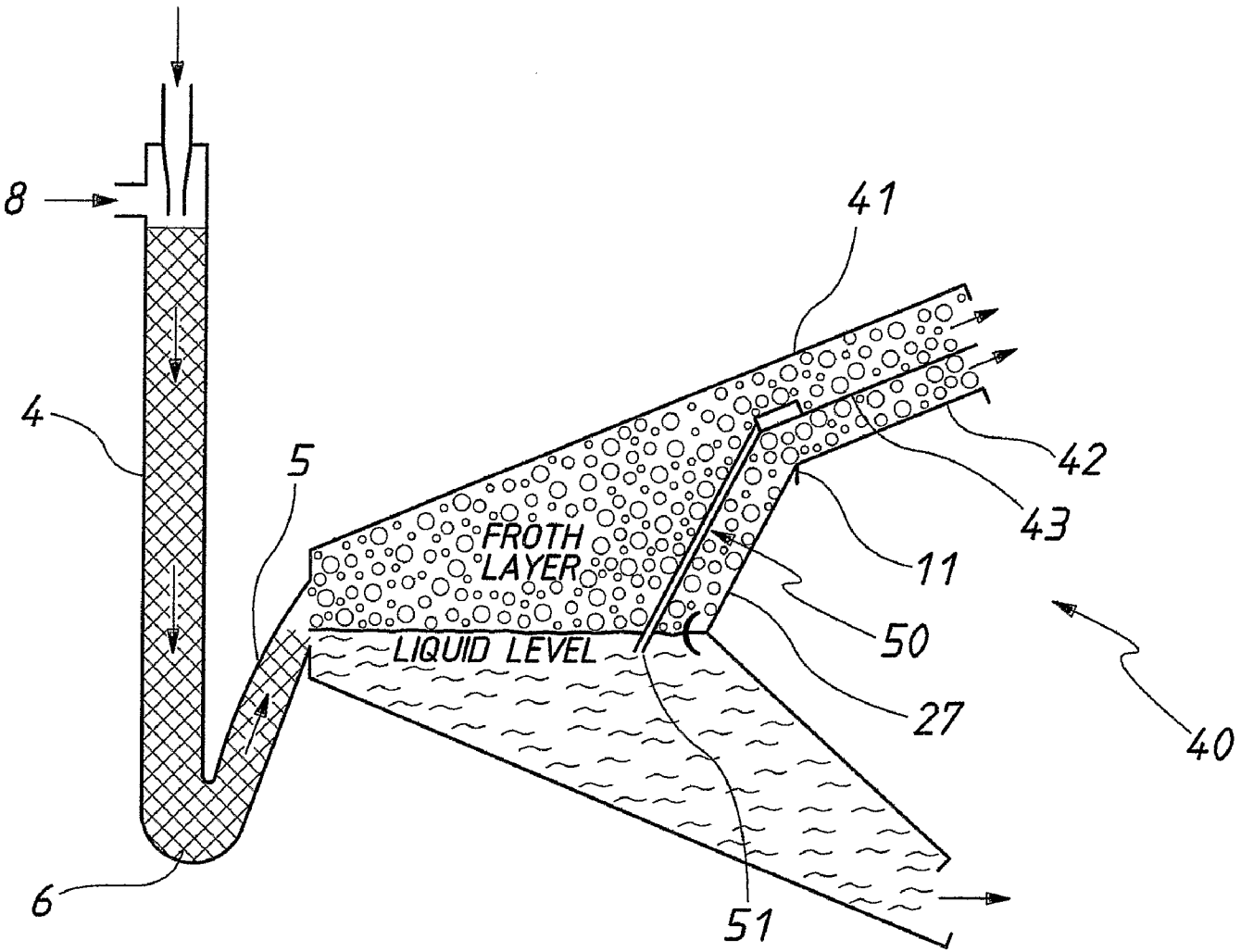
FIG. 5 is a diagrammatic cross-section of a cell similar to that shown in FIG. 3 with an additional wash channel added to the outlet.

Turning now to FIG. 5 there is shown a cell similar to that previously described with reference to FIGS. 3 and 4 to which a wash channel generally shown at 40 has been added above the previous launder lip 11. The wash channel defined by upper plate 41 and lower plate 42 serves to move the froth to which the hydrophobic particles are attached upwardly within the wash channel allowing for the introduction of wash water in a similar manner to that previously described with reference to FIG. 2.

Figure 6:
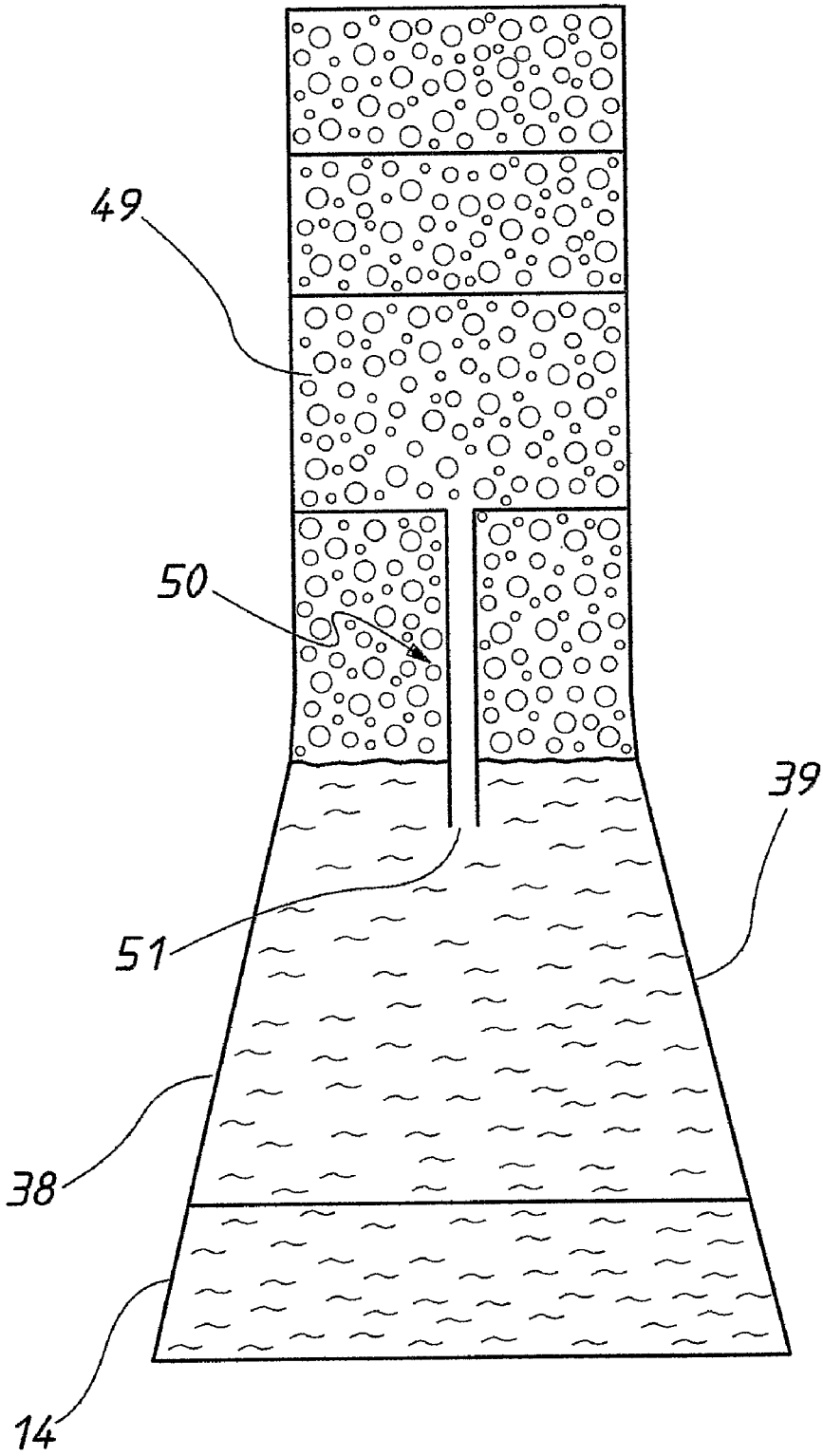
FIG. 6 is an end view of the flotation cell shown in FIG. 5.
Figure 7:
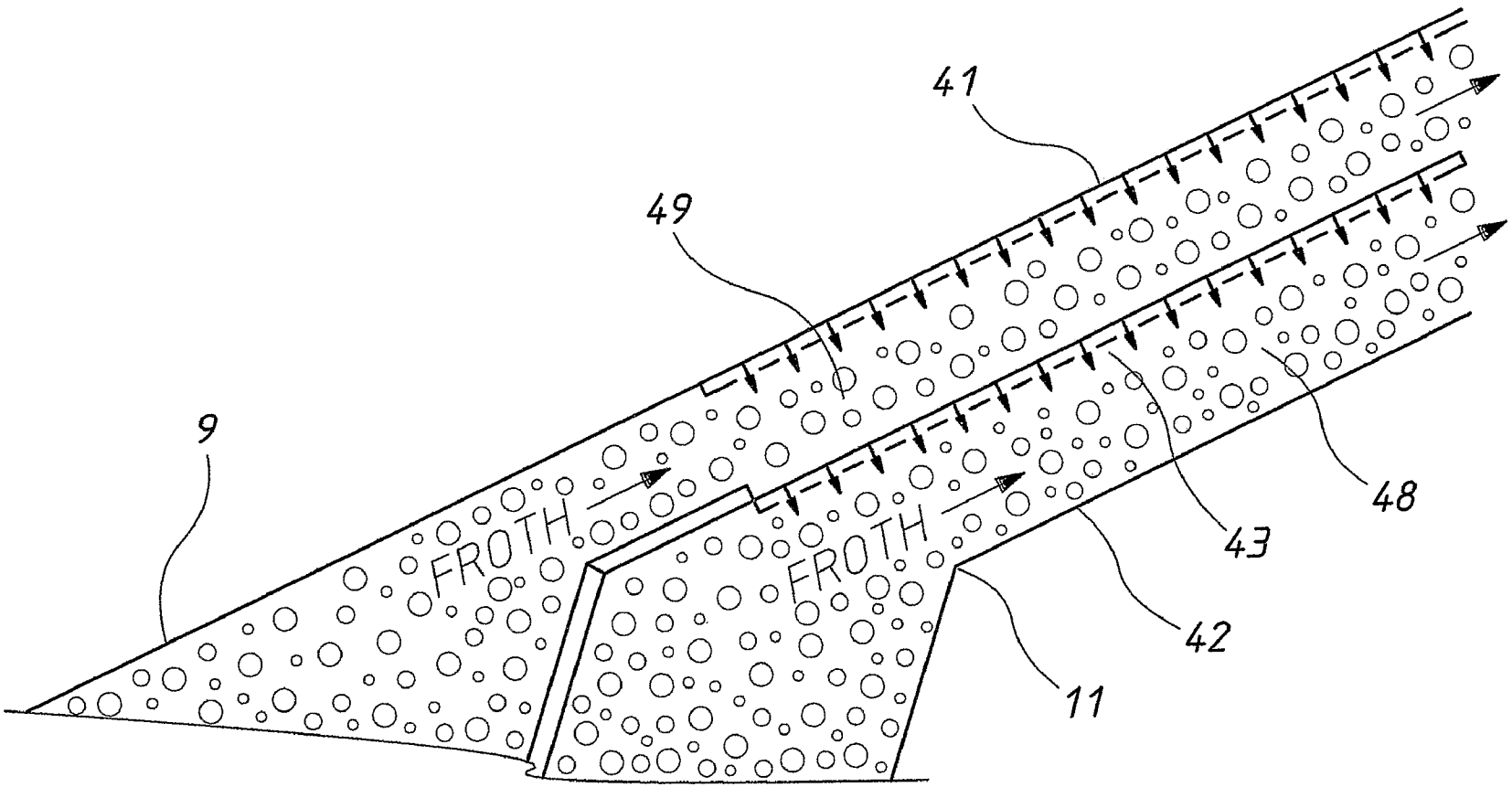
FIG. 7 is a cross-sectional elevation to an enlarged scale through a portion of the wash channel shown in FIG. 5.

In the configuration shown in FIGS. 5 and 6 however the wash channel incorporates one or more intermediate plates 43 through which the wash water can be introduced in a particularly effective manner as will be described further with reference to FIGS. 7, 8 and 9.

Figure 8:
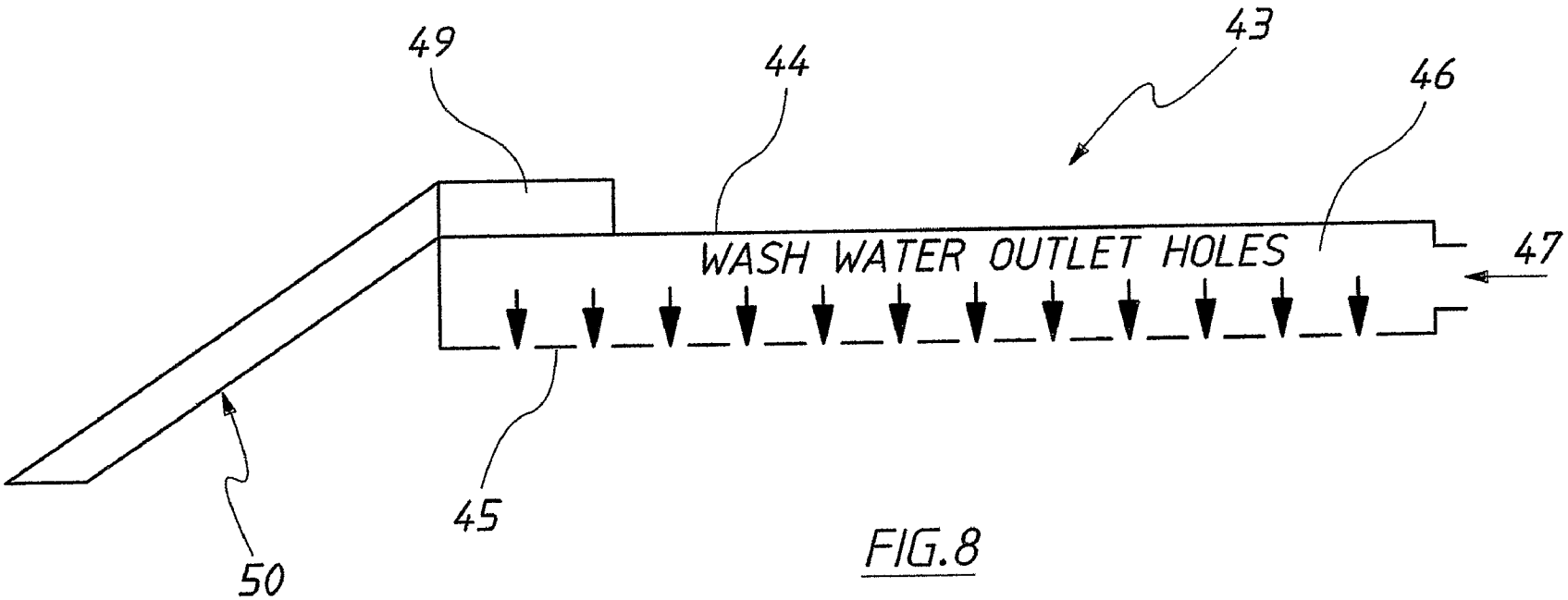
FIG. 8 is a diagrammatic enlargement of a portion of FIG. 7 showing the configuration of one of the plates in the wash channel.
Figure 9:
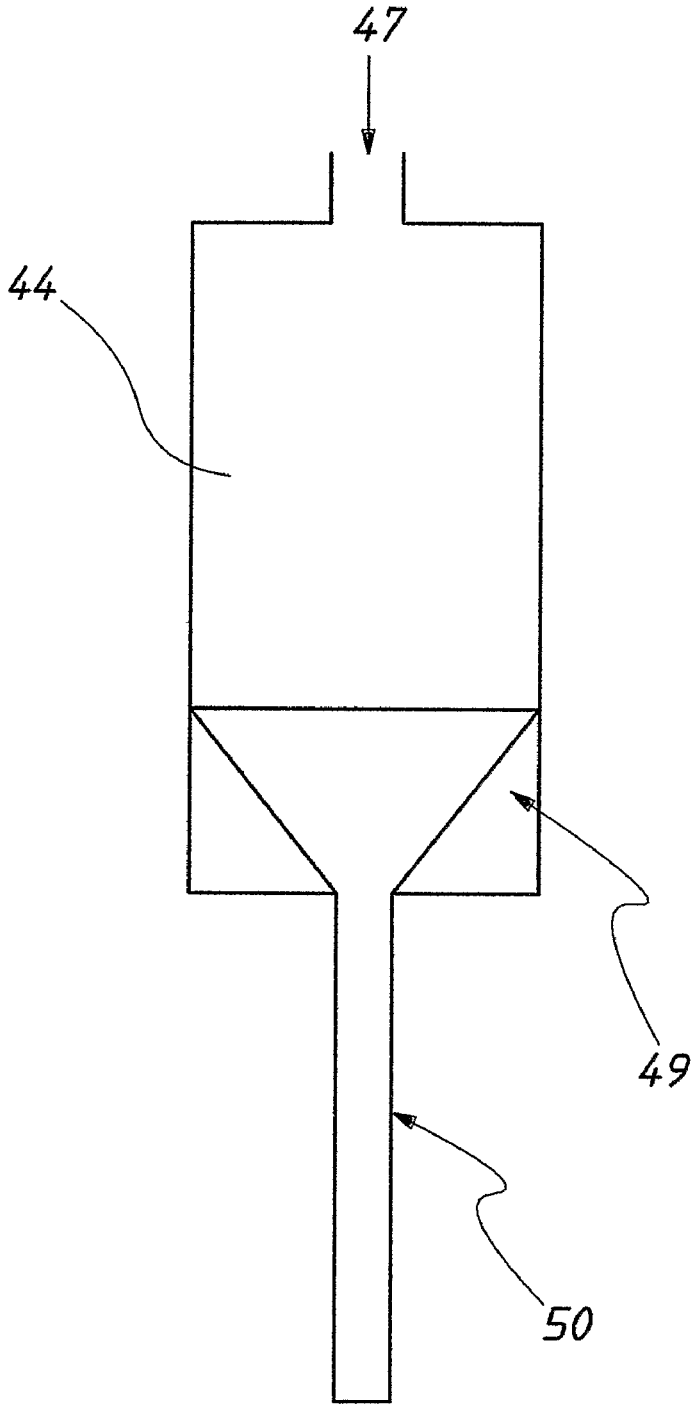
FIG. 9 is a diagrammatic plan view of the plate shown in FIG. 8.

FIG. 8 is an enlarged diagrammatic cross-section through plate 43 showing that the plate is formed from two parallel plates being an upper solid plate 44 and a lower perforated plate 45. Wash water is introduced into the cavity 46 between plates 44 and 45 at the upper edge as shown at 47 and is discharged out through holes in the perforated plate 45 into the froth layer 48 below the plate 43.

In a similar manner the upper plate 41 is also provided in a double sided perforated chamber to feed wash water through the perforated holes in the froth layer 49 in the upper channel formed between plates 41 and 43.

The wash water issuing from the perforated plates is particularly effective in washing any remaining hydrophilic particles contained in the froth onto the surface of the plate below, which in the case of plate 42 can then drain down inclined surface 27, around nose portion 29 guided by deflector 32 and quietly into the liquid in the lower portion of the cell. In order to prevent similar washed particles from plate 43 disturbing the froth layer in the upper part of the cell a catch weir 49 is provided on the upper part of the lower edge of the plate 43 configured as a funnel as can be clearly seen in FIG. 9 to catch liquid flowing down the upper surface of plate 43 and guide it via funnel outlet 50 through the froth layer and into the liquid at its lower end 51 (FIG. 5) where it can discharge into the liquid in the lower part of the cell without disturbing the froth layer above.

Figure 10:
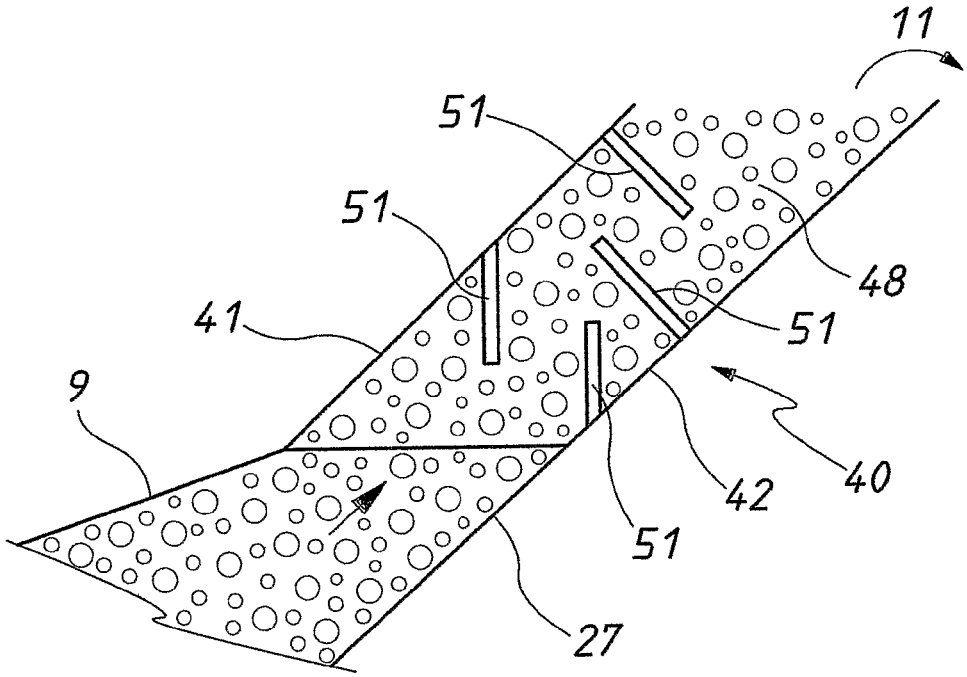
FIG. 10 is a diagrammatic cross-sectional elevation through an alternative construction for introducing wash water into the wash channel.

Although two particular methods have been shown of distributing wash water in the froth channel, firstly with reference to FIG. 2 and secondly with reference to FIGS. 5 to 9, it will be appreciated that there are many other ways of introducing wash water into the froth channel 40. For example, as can be seen in FIG. 10 the wash channel can be provided with a plurality of fingers 51 that protrude into the froth 48 to assist with drainage of the froth. The wash water can be introduced either through hollow fingers 51 with holes drilled in them or via separate devices e.g. of the type shown in FIG. 2. The fingers may be at a variety of angles and extend from any side of the froth channel 40.

Figure 11:
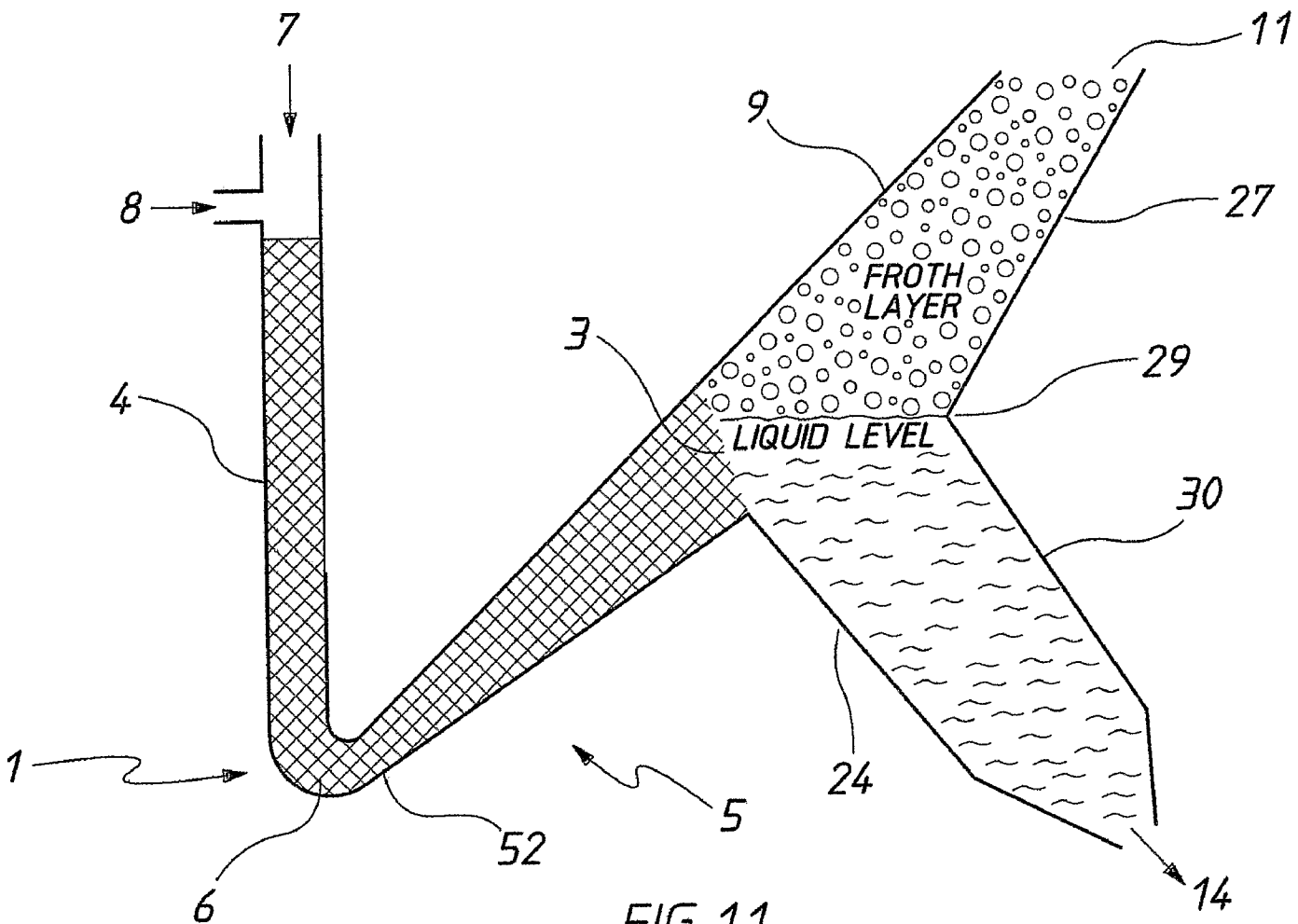
FIG. 11 is a diagrammatic cross-sectional elevation through an alternative form of the flotation cell shown in FIG. 3 incorporating a flared feed from the mixer.

Turning now to FIG. 11 there is shown an alternative version of the cell previously described with reference to FIG. 3 where the second conduit 5 feeding the bubbly mixture from the mixer 1 into the cell at outlet point 3 increases in cross-section from its lower end 52 to the point of discharge 3 into the separation vessel. In some circumstances this flared exit to the mixing tube has been found beneficial in reducing the velocity of the bubbly mixture as it enters the separation vessel, enhancing the settled and non-turbulent flow within the separation vessel.

It is a particular feature of the flotation vessel according to the invention (in all of its embodiments) that it is able to operate effectively with atmospheric air input at 8 and low pressure feed of the slurry at 7 typically through nozzle 53 (FIG. 3) to form the downwardly plunging jet in the first conduit 4.

Figure 12:
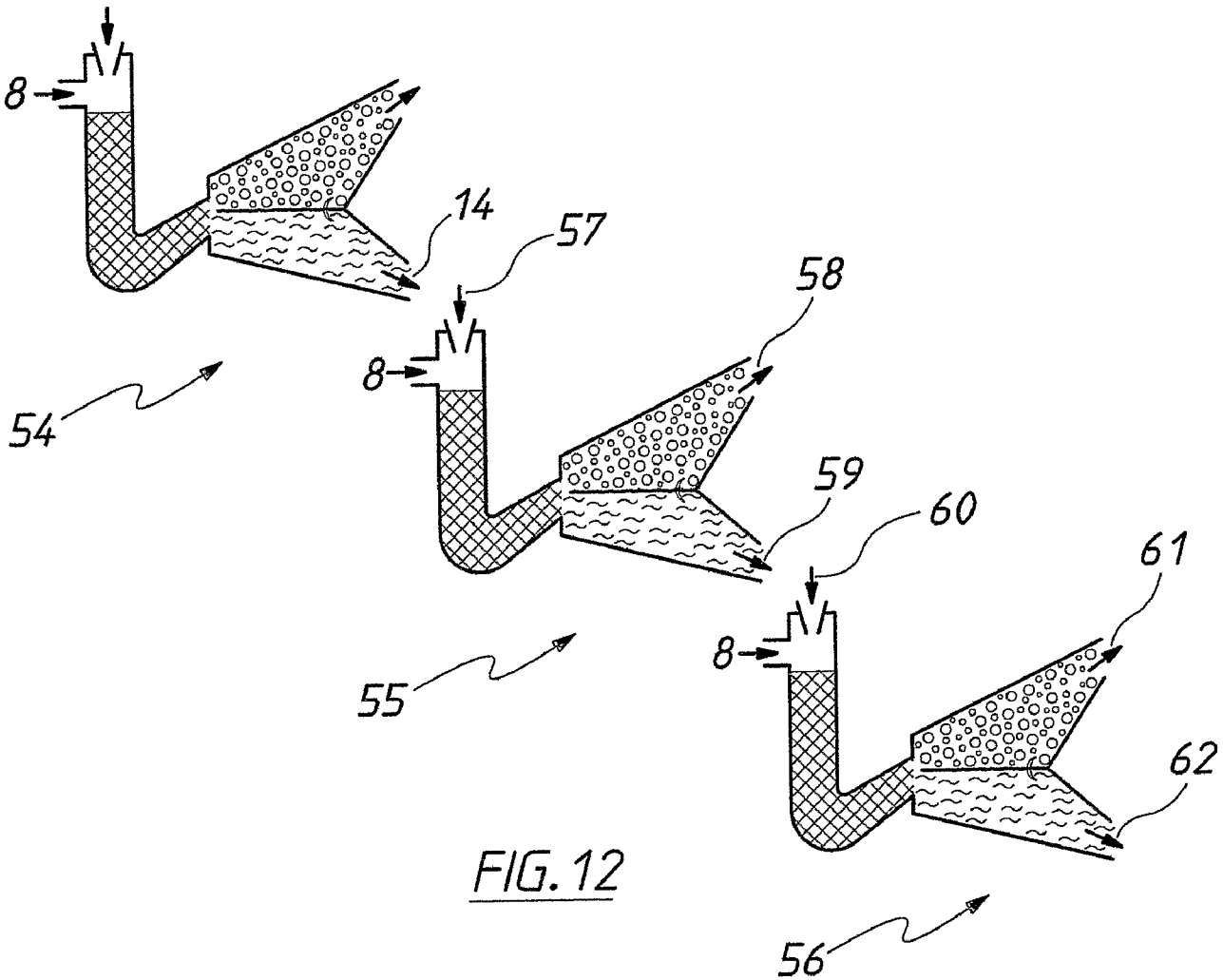
FIG. 12 is a diagrammatic elevation of a plurality of flotation cells according to the invention in a ganged feed arrangement.

The use of gravity feed and air feed at atmospheric pressure significantly reduces the operating cost of the cell as there is no need to provide high pressure pumps for the feed slurry or air compressors for the air feed at 8. These components also make up a significant portion of the capital cost of a flotation plant and because of this cost benefit it is cost effective to gang together two or more cells of this type to achieve even better operating efficiencies. A typical arrangement of ganged cells is shown in FIG. 12 where a first cell 54 is shown feeding a second cell 55 and then to a third cell 56. In each case atmospheric air is introduced at 8 as previously described and the initial slurry fed at 7 into the first or top cell.

With the cells arranged one above the other as shown in FIG. 12 the tailings outlet 14 from cell 54 can be fed as the feed 57 into the second cell 55 where it is again processed in the manner described above to give a beneficial output at 58. This process can be repeated as required by feeding the tailings outlet 59 from cell 55 as the feed 60 into cell 56 again giving a refined beneficial output at 61 and further refined tailings finally issuing from the last cell at 62.

Due to the lower capital cost of cells made according to the invention it is very cost effective both in capital and in operating cost to gang together a number of cells as shown in FIG. 12 for highly efficient plan operation.

The use of a gang of cells also allows a variety of products to be produced from a single feed, ie a different product from each cell in the gang. In the case of coal, these could be different particle size and ash value products. Different particle sizes and different ash value components of a feed have different levels of hydrophobicity. Each cell could be set up to predominately collect particles of a certain hydrophobicity and thus a range of products could be produced. This can have certain advantages in increasing plant efficiency. As example of this would be to produce a low ash value coking product coal and a higher ash value thermal product coal. Another example would be to collect high grade minerals or coal in one (or more cells) and collect a lower grade mineral or coal form other cells. This lower grade mineral or coal could then be reground to increase liberation of the valuable mineral (or mineral matter in the case of coal) and fed back into the flotation feed. This would increase the yield of high grade mineral or coal.

The use of a gang of cells also allows the final cell or cells to be used in the frother stripping mode, as described in our co-pending PCT Application PCT/AU2007/000904.

Another advantage of the flotation cell according to the invention is that it may be easily retrofitted to an existing flotation plant. Especially if the gravity fed version is used, then it can usually be added under existing flotation cells. This new cell can then be used to strip frother from the tails of the existing cell or to improve flotation performance.

Another advantage of a gang of cells is to allow multiple reagent dosing points. This can help produce the variety of products discussed above and also reduce reagent consumption rates, as compared to a single dose point.

The flotation cell according to the invention may be pump fed, but can also operate at minimum feed pressure and so can lend itself to gravity feed with little head required. It can also operate at a constantly changing liquid feed rate (between a minimum and a maximum). The air inlet is fully open to the atmosphere so no control of air-rate is necessary.

The improved wash-water and froth collection systems allow for excellent removal of entrained particles in the froth and yet still produce a relatively "dry" froth. This is something that is usually not possible if wash-water is used. The improved wash-water systems also allow for multiple wash and drain sections. This dramatically increases the performance of froth washing and drainage. The use of plates (or "fingers") in the froth washing and drainage sections and the inclined nature of the froth collection section are what allows this improved performance.

The inclined froth handling system (or froth launder or froth collection system) also greatly increases the ease with which froth can escape from the flotation cell. This increases yield by reducing the amount of hydrophobic particles that fall back into the slurry.

The invention claimed is:

1. A flotation vessel of the type wherein mixed particles are separated into hydrophobic particles generally discharged from the vessel in a froth layer in the form of bubbles with attached particles, and hydrophilic panicles generally discharged as tails, the vessel including a mixer arranged to mix gas with a feed slurry carrying the mixed particles and form a bubbly mixture, and a separation vessel arranged to allow the bubbly mixture to separate into a froth bearing the hydrophobic particles for discharge from he upper part of the vessel, and a liquid containing he hydrophilic particles for discharge from the lower part of the vessel as tails, the mixer and the separation vessel being arranged such that the bubbly mixture enters the separation vessel in a generally upward direction and the separation vessel is provided with an upwardly inclined surface above the point of entry of the bubbly mixture such that the bubbly mixture follows the underside of this surface separating into a froth layer at the top of the separation vessel and liquid in the lower part of the separation vessel, with the result that the bubbles with attached hydrophobic particles continue to move upwardly into the froth layer in the vessel without a significant change in direction of movement;

wherein the lower part of the separation vessel is provided with a surface sloping downwardly away from the entry point of the bubbly mixture into the separation vessel, and having a lower edge terminating in a tails outlet; and wherein the vessel has a side opposite the entry point of the bubbly mixture which has an upper part inclined inwardly into the vessel from an upper edge adjacent the discharge point to a nose portion substantially opposite said entry point, and a lower part inclined outwardly from the nose portion to a lower edge adjacent the tails outlet.

2. The flotation vessel as claimed in claim 1 wherein the upwardly inclined surface has a lower edge located in close proximity to the entry point of the bubbly mixture into the separation vessel, and extends across the separation vessel to a higher edge located adjacent the exit point of froth from the separation vessel.

3. The flotation vessel as claimed in claim 2 wherein the exit point of the froth from the separation vessel is over a lip in the side wail of the vessel and into a launder.

4. The flotation vessel as claimed in claim 1, wherein the nose portion is provided with a deflector plate spaced outwardly from the nose portion and arranged to divert liquid flowing down the upper part, around the nose portion so as to substantially follow the line of the lower part.

5. The flotation vessel as claimed in claim 1, wherein the froth layer is discharged from the vessel through an upper inclined wash channel extending from the upper edge of, and generally in line with, the upwardly inclined surface, arranged such that wash water introduced into froth moving upwardly through the wash channel washes out hydrophilic particles remaining in the froth which are guided dowinwardly from the wash channel into the lower part of the vessel.

6. A flotation vessel as claimed in claim 1 wherein the mixer includes a first substantially upright conduit where the feed slurry is mixed with the air introduced at substantially atmospheric pressure to form the bubbly mixture moving downwardly through the first conduit, and a second upright or inclined conduit having its lower end in communication with the lower end of the first conduit, wherein the bubbly mixture moves upwardly in the second conduit, the upper end of the second conduit being lower than the upper end of the first conduit.

7. The flotation vessel as claimed in claim 6 wherein the fled slurry is fed into the upper end of the first conduit through a nozzle as a downwardly plugging jet.

8. The flotation vessel as claimed in claim 6, wherein the lower end of the first conduit communicates with the lower end of the second conduit by way of a curved extension of the conduits, forming a U-tube.

9. The flotation vessel as claimed in claim 6, wherein the second conduit is of sufficient length that hydrophobic particles dislodged from bubbles during upward movement of the bubbly mixture in the second conduit have the opportunity to attach to further bubbles moving upwardly within the second conduit.

* * * * *